United States Patent [19]

Mose et al.

[11] 4,210,516

[45] Jul. 1, 1980

[54] ELECTRODE ELEMENT FOR MONOPOLAR ELECTROLYSIS CELLS

[75] Inventors: Luciano Mose, Dortmund; Helmut Schurig, Holzwickede; Bernd Strasser, Hamm, all of Fed. Rep. of Germany

[73] Assignee: Hooker Chemicals & Plastics Corp., Niagara Falls, N.Y.

[21] Appl. No.: 39,984

[22] Filed: May 17, 1979

[30] Foreign Application Priority Data

May 19, 1978 [DE] Fed. Rep. of Germany ..... 2821984

[51] Int. Cl.[2] ..... C25B 11/03; C25B 11/02; C25B 9/04

[52] U.S. Cl. ..... 204/284; 204/289; 204/257

[58] Field of Search ..... 204/284, 288, 289, 280, 204/283, 263–266, 267, 257–258

[56] References Cited

U.S. PATENT DOCUMENTS

| | | | |
|---|---|---|---|
| 2,161,166 | 6/1939 | Hunter | 204/258 |
| 2,872,406 | 2/1959 | Buchanan | 204/257 X |
| 2,967,814 | 1/1961 | Tuwiner | 204/284 |
| 3,940,328 | 2/1976 | Thomas et al. | 204/283 |
| 4,048,045 | 9/1977 | Eng et al. | 204/257 X |

*Primary Examiner*—John H. Mack
*Assistant Examiner*—D. R. Valentine
*Attorney, Agent, or Firm*—Peter F. Casella; William G. Gosz

[57] ABSTRACT

Electrode elements are provided for monopolar electrolysis cells useful in chlor-alkali electrolysis and having two vertical, planar, opposed electrode surfaces, said surfaces being substantially parallel and spaced apart from one another and being electrically fastened to an electrode frame, said electrode element being characterized in that at least one electrode rod is connected in electrically conductive fashion to the side portion of said electrode frame, extending through the space between said opposed electrode surfaces substantially parallel to said electrode surfaces, the diameter of said rod being smaller than the distance between said opposed electrode surfaces, said electrode rod being provided with conductive members distributed over the length thereof and connected in electrically conductive fashion to both the electrode surfaces and the electrode rod.

30 Claims, 20 Drawing Figures

ELECTRODE ELEMENT FOR MONOPOLAR ELECTROLYSIS CELLS

BACKGROUND OF THE INVENTION

This invention pertains to electrode elements for monopolar electrolysis cells having planar, opposed electrode surfaces arranged vertically and substantially parallel to one another, and fastened along with electrode connections to an electrode frame. Such electrolysis cells are especially useful for chlor-alkali electrolysis.

Electrolysis cells of this type are typically useful for chlor-alkali electrolysis wherein chlorine, hydrogen and alkali hydroxides are prepared from aqueous alkali chloride solutions by the application of electrical energy,. Chlorine is also obtained as a by-product of the electrolysis of molten salts used in the manufacture of alkali metals or alkaline earth metals. Cells of this type have also been increasingly used in the electrolytic decomposition of hydrochloric acid, and are becoming more significant in this respect.

Some of these products are manufactured in very large quantities as basic chemicals. In the case of chlor-alkali electrolysis, plants are frequently operated with individual current loop production capacities of 500 to 1,000 tons of chlorine per day. In such plants, current intensities of up to about 500,000 amps are attained. Depending upon the particular process used, larger or smaller numbers of electrolysis cells may be combined into a single circuit.

If an electrical direct current flows through an electrochemical cell having an alkali chloride-containing aqueous electrolyte, chlorine gas is primarily formed at the positive pole or anode, while hydrogen gas and alkali hydroxide form at the negative pole or cathode. Reverse reaction due to mixing of the product should, of course, be prevented. For this purpose, two different processes were initially developed: the so-called mercury process and the diaphragm process.

In the diaphram process, a porous separating wall (diaphragm) separates the anode chamber from the cathode chamber and thus prevents mixing and the undesirable reverse reaction of the products separated at the electrodes.

Recently a third electrolysis process, the so-called membrane cell process, has increasingly come into use. Since dimensionally stable anodes and permselective membranes are now available, the electrolysis cells can be manufactured with a thin separating membrane clamped between flat opposed electrodes.

The successive combination of several electrolysis cells of this type yields a cell block with a filter-press-like structure. These filter-press type electrolysis cells are known, for example, from German Pat. No. 1,054,430 and German Offenlegungsschrift No. 2,222,637, the disclosures of which are incorporated herein by reference, which illustrate the electrolysis of aqueous hydrochloric acid, and from German Offenlegungsschrift No. 2,510,396, directed to chlor-alkali electrolysis, the disclosure of which is also hereby incorporated by reference.

In general, the cell elements are held in supporting frames. With the aid of a suitable pressing device, for example a hydraulic press, a tension bar or individual screws, the cell block is pressed together with gaskets placed between the cell elements to seal them off one another, and pressed together to form a rigid unit containing from about 10 up to, for example, 100 cell elements, and having a corresponding production capacity. Such a unit may, if desired, be mounted on a suitable frame.

The electrolysis filter-press type cells can then be connected in bipolar fashion, as illustrated in U.S. Pat. No. 4,056,458, the disclosure of which is hereby incorporated by reference, or, alternatively, in monopolar fashion. If a bipolar arrangement is employed, the first and last electrodes will each have a current connection with the current flowing in a longitudinal direction through the cell block. In such a circuit, either liquid-tight electrodes, which have different polarities on each of their two sides, are used or, alternately, separating walls are provided for current connection between the opposite electrodes.

In a monopolar arrangement of filter-press type electrolysis cells, each electrode frame typically contains two electrodes of similar polarity, and the electrolysis cell block is typically made up by arranging corresponding anodic and cathodic frames alternately in succession. In this manner, a suitable separating wall, for example a membrane or a diaphragm, is supplied to separate the anode chamber from the cathode chamber formed between adjacent electrode frames. Each electrode has an external current connection, which is suitably connected to the opposite electrode of another electrolysis cell, wherein the electrolysis current flowing into each electrode frame is distributed over the electrode surface, flowing perpendicularly to the electrode surface through the electrolyte gap to the opposite electrode, and finally leaves the corresponding adjacent electrode frame of opposite polarity. All electrodes of the same polarity are preferably connected in parallel. An arrangement of this type is aptly described, for example, in applicant's concurrently filed patent application Ser. No. 39,997 relating to an electrolysis cell system the disclosure of which is hereby incorporated by reference.

To facilitate the introduction of the electrolysis current to the electrode surfaces of an electrode element, it is possible to place a corrugated panel with stamped lugs between the two electrode surfaces of an electrode element. The lugs may be connected to the electrode surfaces, for example, by resistance welding. These lugs provide for the transmission of current between the two electrode surfaces and the corrugated panel since they are raised above the corrugations and form a gas-permeable canal between the corrugations and the back of the electrode surface. This gas-permeable channel is necessary to enable the gas generated at the electrode to flow upward without impediment.

There are technical limits to the increase in performance of the electrolysis cell which can be achieved by means of higher specific current loadings with electrode elements of this type. For example, the cross-section of the corrugated spacing panel between the electrode surfaces cannot be enlarged indefinitely due to the possibility of deformation. In addition, manufacturing the electrically conductive connection of the spacing panel with the electrode frame or with the wall of the electrolysis vessel is rather difficult and expensive.

It is thus a primary object of the present invention to provide an improved electrode element of the type described above which will have a simple structure and will permit a high electrolysis current.

In order to achieve this object, a current supply device of the largest possible cross-section between the two electrode surfaces of an electrode element is desired which is, in addition, electrically connected with the electrode surface only at certain points in order to leave room for the passage of the separated gas and other electrolysis fluids between the power supply point and the electrode surfaces.

SUMMARY OF THE INVENTION

In accordance with the present invention, this object is achieved by providing at least one electrode rod conductively connected with the electrode contact and extending through the space between the electrode surfaces substantially parallel to said surfaces—the diameter of the rod being smaller than the distance between the two electrode surfaces—with the electrode rod having conductive members distributed over its length which are connected in electrically conductive fashion with the electrode surfaces and the electrode rod. Within the framework of the invention, a plurality of such electrode rods, preferably parallel to one another, can be arranged between the electrode surfaces, the electrode rods preferably having circular, rectangular, or squared cross-sections. The only essential feature, in this respect, is that the dimensions of the electrode rod be smaller than the distance between the two parallel electrode surfaces. The conductive members distributed at the various points over the electrode rods, which are also directly connected in electrically conductive fashion with the electrode surfaces, provide good electrical transition between the electrode rods and the electrical surfaces, and also assure largely unimpeded passage of the electrolysis media or fluid through the electrode elements.

The electrode rods preferably extend in the horizontal direction and are aligned so that they are substantially parallel to one another. In this manner, a uniform distribution of the electrical connections for the electrode surfaces is achieved.

In accordance with the present invention, in order to reduce the number of electrode rods per electrode element for the same current loading, the electrode rods have a core whose electrical conductivity is larger than that of the rod jacket. The electrode rods and/or conductor sections are preferably made of metal.

The number of electrode rods in an electrode element is selected to correspond to the planned current load of the individual electrode element to provide a simple means for increasing the capacity of the electrolytic cell.

In a preferred embodiment, the conductive members are designed as current distributor panels and are preferably positioned vertically and perpendicular to the electrode surfaces.

In another preferred embodiment, the conductive members are formed as coaxial rings on the electrode rods, the axial length of the rings being preferably smaller than the distance between the rings on the electrode rod.

In yet another preferred embodiment of the invention, the conductive members are formed into a cam profile running spirally on the circumference of the electrode rod.

The various advantages of the present invention will now be described in greater detail by reference to the attached drawings.

DETAILED DESCRIPTION OF THE PREFERRED EMBODIMENTS

Figure 1:
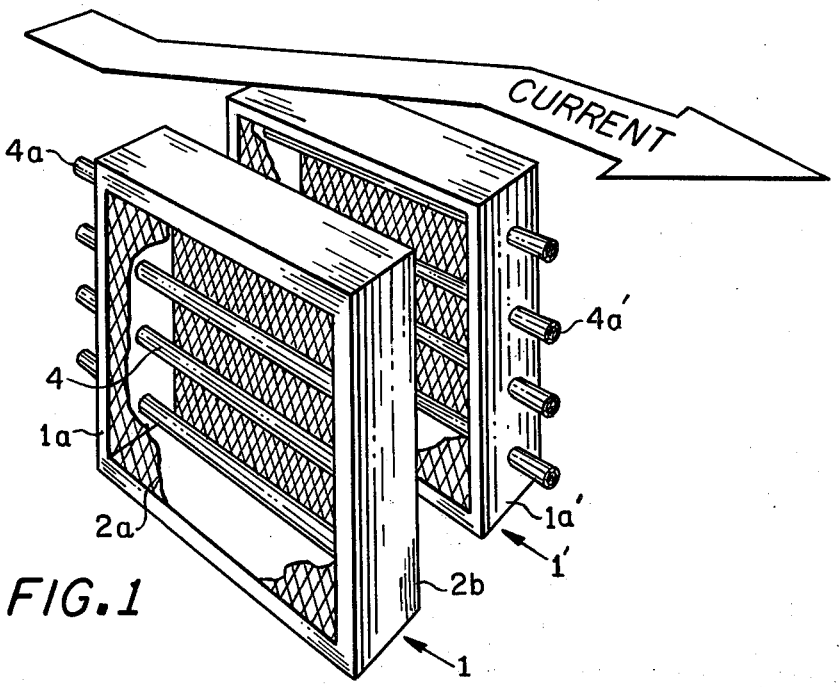
FIG. 1 shows a schematic perspective view of two adjacent electrode elements illustrating the direction of current flow.

In accordance with FIG. 1, the electrode elements comprise a rectangular or square electrode frame 1, on both sides of which electrode surfaces 2*a* and 2*b* are arranged at parallel distances from one another. Preferably, both the electrode frame 1 and the electrode surfaces 2*a* and 2*b* are fabricated of metal and are welded together in order to produce an electrical connection. The current supply is provided by current connections 4*a* and electrode rods 4 on the outside of a side portion 1*a* of the electrode frame 1, or on the interior of the electrode frame between the parallel electrode surfaces 2*a* and 2*b*.

In a monopolar filter-press type electrolysis cell, the current flows from the electrode connections 4*a* of electrode element 1 over the corresponding electrode frame and the electrode surfaces 2*a* and 2*b* to the electrode surfaces of the adjacent electrode element 1', only one of which is shown.

Figure 2:
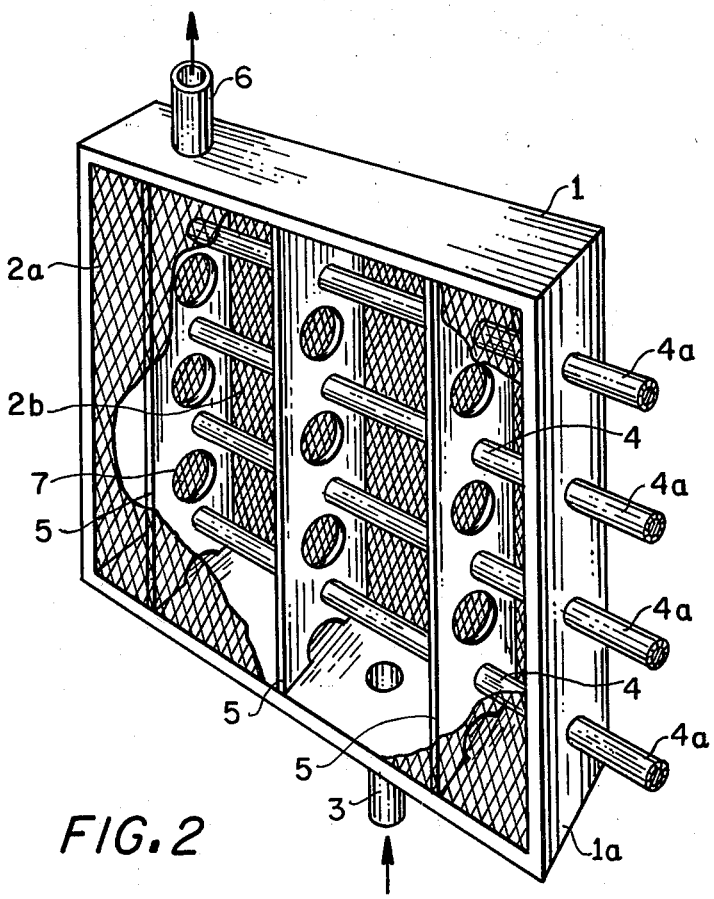
FIG. 2 is a perspective drawing of one embodiment of the electrode element of the present invention.

In FIG. 2, the outer current connections 4*a* are likewise arranged on the lateral, vertical wall of the electrode frame 1. The electrode rods 4 connected to these current connections 4*a* extend into the interior of this electrode frame, and are horizontal and parallel to the electrode surfaces 2*a* and 2*b*. The number of electrode rods 4 is selected to correspond to the desired current-carrying capacity of the electrode element. In the present embodiment, four parallel electrode rods 4 are provided. The monopolar electrode element 1 forms an electrolyte chamber which is supplied with electrolyte through a suitable connection 3. The consumed electrolyte, as well as the electrolysis products, leave the interior chamber of the electrode element 1 through another connection 6.

In order to provide an additional electrical connection between the electrode rods 4 and the electrode surfaces 2a and 2b, vertically arranged current distributor panels 5 are provided, which in turn are connected by their longitudinal sides at various points, or in continuous fashion, with the electrode surfaces 2a and 2b, and with the electrode rods 4, extending horizontally through the current distributor panel 5, in an electrically conductive manner such as by welding.

As a result of their positioning, the current distributor panels 5 simultaneously serve as spacers for the electrode surfaces 2a and 2b, and thus present substantially no impediment to the flow of the electrolyte and the electrolysis products.

The current distributor panels 5 are preferably fabricated from the same material as the electrode frame 1. The vertical arrangement of the current distributor panels 5 produces chambers in which good mixing of the electrolyte takes place due to contact with gas bubbles. In order to allow for the exchange of the electrolyte from one chamber to another, holes 7 are suitably provided in the current distributor panels 5.

Figure 3:
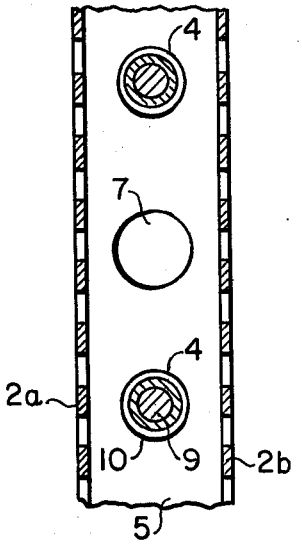
FIGS. 3, 4 and 5 show various partial sectional views of the electrode element in accordance with FIG. 2.
Figure 4:
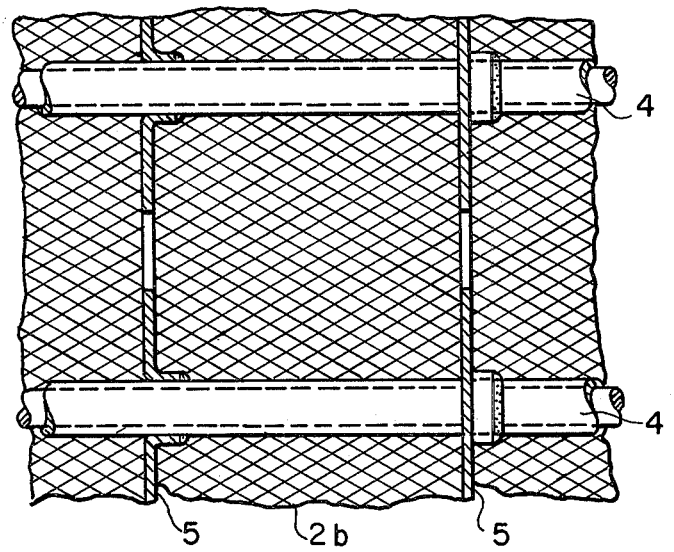
Figure 5:
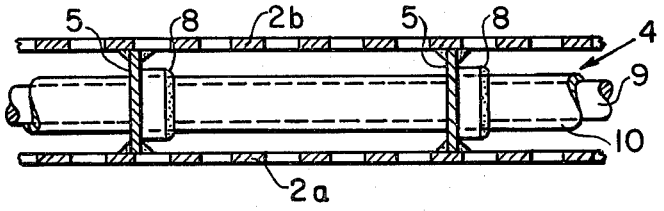

Various partial sectional views of the electrode element 1 in accordance with FIG. 2 are presented in FIGS. 3, 4 and 5. The electrode rods 4 preferably comprise a core 9 of a highly conductive metal, for example copper, and are surrounded by a metal jacket 10 which is stable in the particular electrolysis medium. For example, iron or nickel are suitable for the cathode element, and titanium is suitable for the anode element as a material of construction for the rod jacket 10.

The current distributor panels 5 can be manufactured simply and to accurate dimensions, for example by stamping, wherein the external form and the perforation with the neck 8 for welding with the electrode rod 4 and the hole 7 can be produced in one working pass.

By welding the rods 4 to the current distributor panels 5, and welding these panels 5 on both sides with the electrode surfaces 2a and 2b, which may be fabricated, for example, from perforated sheet metal, expanded metal, metal mesh or individual thin rods, a very stable sandwich construction is obtained, wherein the two electrode surfaces 2a and 2b form the front and rear sides of the sandwich construction.

Figure 6:
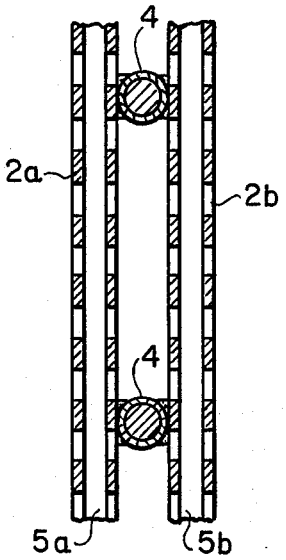
FIGS. 6, 7 and 8 show various partial sectional views of an electrode element in accordance with FIGS. 3, 4 and 5 respectively.
Figure 7:
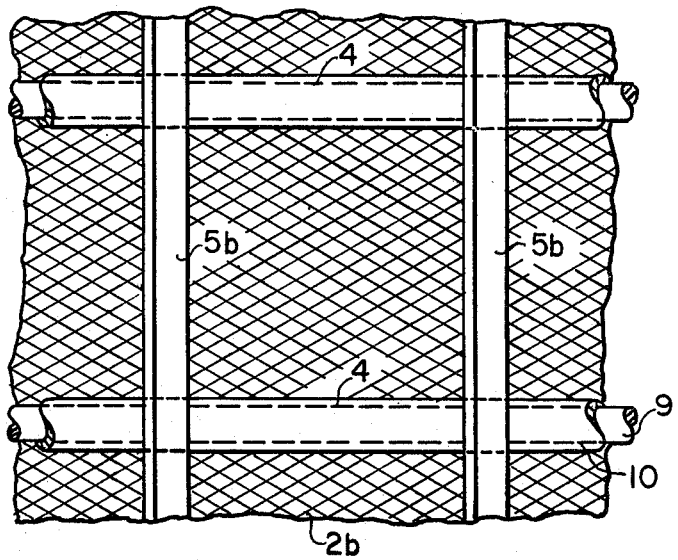
Figure 8:
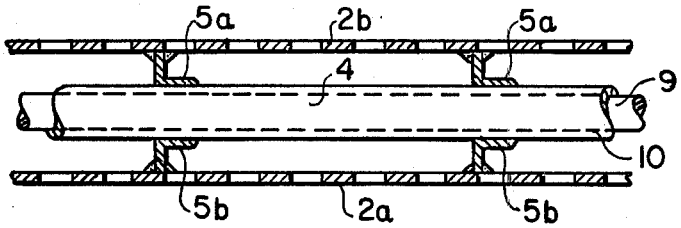
Figure 9:
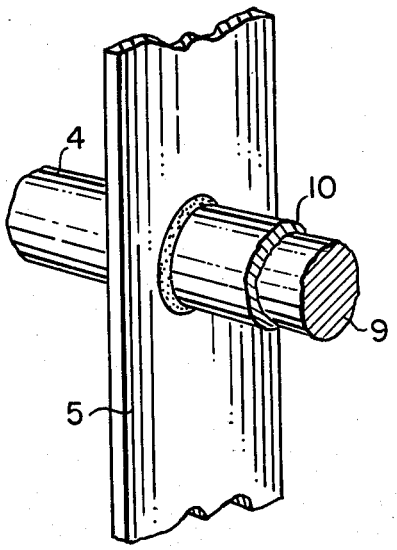
FIGS. 9, 10 and 11 show perspective views of the fastening of the electrode rod in the current distributor panels.
Figure 10:
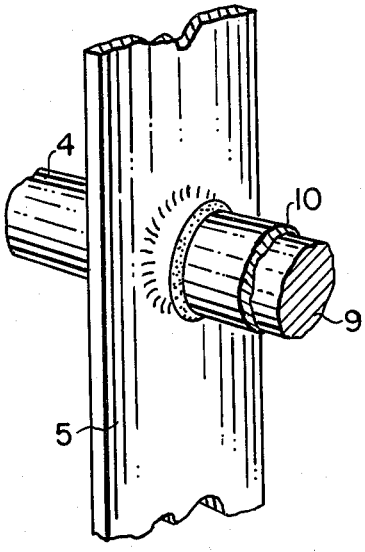
Figure 11:
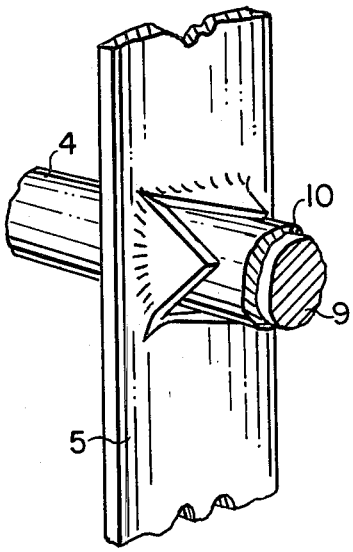
Figure 12:
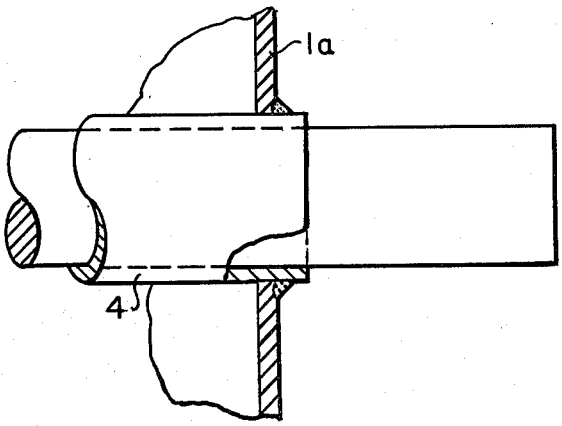
FIG. 12 shows a partial sectional view of the connection of an electrode rod with the electrode frame.

In the embodiment of FIGS. 6, 7 and 8, the current distributor panels consist of two angle profiles 5a and 5b, wherein one arm, seen in cross-section for example in accordance with FIG. 8, extends perpendicular to the electrode surfaces 2a and 2b, while the other arm is parallel to said electrode surfaces. The free end of the first-mentioned arm is welded to the electrode surface, and the other arm of angle profiles 5a and 5b is welded to the electrode rod 4.

FIGS. 9, 10, 11 and 12 show various possible connections between the electrode rod 4 and the current distributor panels 5, or the frame 1, in detail. The electrode frame 1 is preferably fabricated from metal, wherein different metals are used for the anodes and cathodes. Suitable metals for the anodes and cathodes are the same as those discussed previously in connection with the rod jacket 10. An advantage of this material selection is that the electrode rod 4 at the passage through the frame wall 1a can be tightly welded to the frame metal, so that an expensive and easily damaged sealed construction can be avoided.

Figure 13:
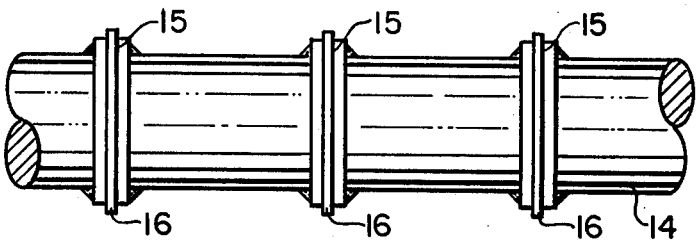
FIGS. 13 and 14 show a side view and a cross-sectional view, respectively, of an electrode rod with spacing rings.
Figure 14:
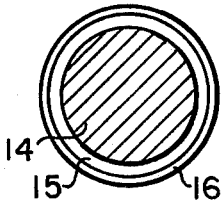
Figure 15:
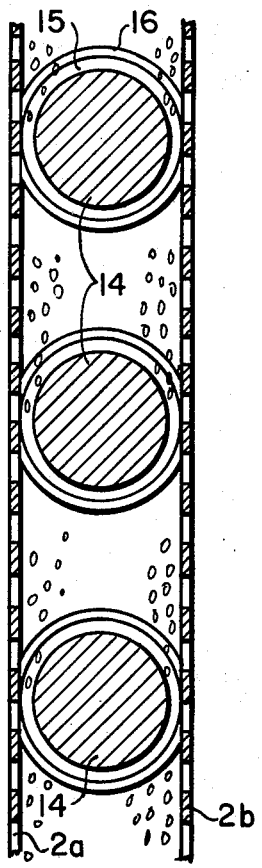
FIG. 15 is a vertical sectional view of an electrode element with the electrode rods in accordance with FIGS. 13 and 14.
Figure 16:
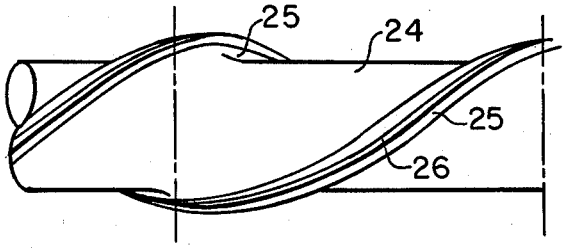
FIGS. 16 and 17 are a side view and a cross-sectional view, respectively, of an electrode rod with a spiral cam profile.
Figure 17:
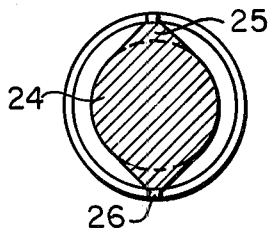

In another embodiment according to FIGS. 13, 14 and 15, the electrode rods 14 have spacing rings 15 made of electrically conductive material and arranged at a distance from one another. The spacing rings 15 are coaxial to one another and to the electrode rod 14, and are preferably formed with the rod as one piece. This electrode rod can, for example, be produced in a cost-advantageous manner on an automatic rotary device.

In order to weld the electrode rod 4 to the electrode surfaces 2a and 2b in accordance with FIG. 15, radially projecting, circular ring attachments 16 are provided on the circumference of the spacing rings 15; the axial dimensions of these attachments being smaller than those of the spacing rings 15. During assembly, these ring attachments 16 come into contact at horizontally opposed points with the electrode surfaces 2a and 2b, and during welding, for example during resistance welding, are melted and thus join the electrode rods to the electrode surfaces. The distance between the electrode surfaces 2a and 2b is thus very precisely determined in the welded condition by the diameter of the spacing rings 15.

Figure 18:
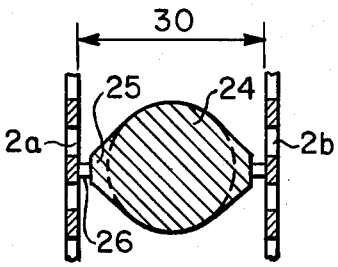
FIGS. 18 and 19 are vertical partial sectional views of an electrode element with electrode rods in accordance with FIGS. 16 and 17 both before and after, respectively, the welding of the cam profile to the electrode surfaces.
Figure 19:
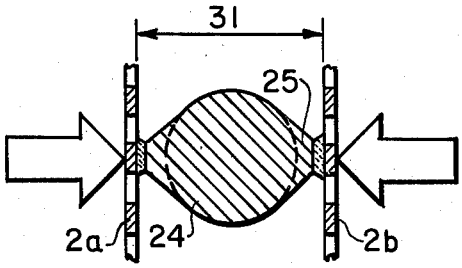
Figure 20:
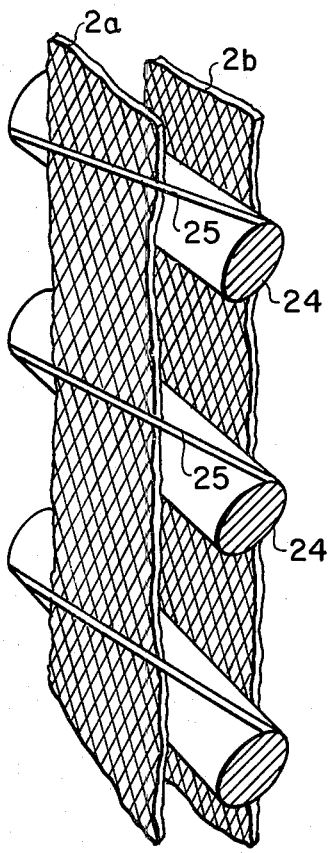
FIG. 20 is a perspective partial view of an electrode element with electrode rods having spiral cam profiles.

In the embodiment of FIGS. 16 to 20, the electrode rod 24 has on its circumference a spirally traversing cam profile 25. Preferably, two or a higher even number of such cam profiles 25 are provided on the electrode rod 24, so that, for example, in accordance with FIGS. 18 and 19, in each case two cam profiles are positioned horizontally opposite one another, and can then be welded to the electrode surfaces 2a and 2b. In order to facilitate the welding process, radially projecting, graduated cam attachments 26 are provided on the cam profiles 25, which when viewed in the axial direction are narrower than the cam profiles 25. As in the case of the embodiment of FIGS. 13, 14 and 15, during the welding of the electrode rod 24 with the electrode surfaces 2a and 2b, the portion of the cam attachment 26 which is in contact with the electrode surfaces is melted, as shown in FIGS. 18 and 19, so that the distance between the electrode surfaces 2a and 2b after welding 31 is somewhat less tha the corresponding distance before welding 30, and is determined solely by the external distance of the horizontally opposed cam profiles 25.

The portions of the cam attachments which are not welded to the electrode surfaces do not impede the flow of the electrolysis media, since they are displaced internally into the electrode element with respect to the electrode surfaces 2a and 2b. The distances between the weld points on the electrode surfaces 2a and 2b and the electrode rods 24 can be adapted easily to the current load requirements by appropriately altering the "twist", i.e., the slope of the cam profile. The electrode rods 24 are advantageously made of rolled steel, which is twisted to the desired degree after final calibration of the cam profile.

As in the embodiments of FIGS. 13, 14 and 15, precise calibration of the rods 14 and 24 provides high manufacturing accuracy for the distance between the two electrode surfaces 2a and 2b, and thus also for the distance of the adjacent electrode element from the electrode surfaces.

Although the present invention has been described in terms of certain specific embodiments, it is to be understood that modifications and variations may be made without departing from the spirit and scope of the invention, as those of ordinary skill in the art will readily understand. Such modifications and variations are considered to be within the purview and scope of the appended claims.

What is claimed is:

1. An improved electrode element for monopolar electrolysis cells comprising, in combination, an electrode frame having electrical current connections, a pair of opposed electrode surface substantially parallel and spaced apart from one another, said electrode surfaces being electrically fastened to said electrode frame, and at least one electrode rod connected in electrically conductive fashion to a side portion of said electrode frame, said rod extending through the space between said opposed electrode surfaces and being substantially parallel to said electrode surfaces, the diameter of said rod being smaller than the distance between said opposed electrode surfaces, said electrode rod having conductive members distributed over the length thereof and connected in electrically conductive fashion with both the electrode surfaces and the electrode rod.

2. The electrode element of claim 1 wherein the electrode rod is substantially horizontal with respect to said frame.

3. The electrode element of claim 1 wherein the electrode rod has a core whose electrical conduction is greater than that of the rod jacket.

4. The electrode element of claim 1 wherein the electrode rod is fabricated from metal.

5. The electrode element of claim 1 or 4 wherein the conductive members are fabricated of metal.

6. The electrode element of claim 5 wherein the conductive members are welded to the electrode surfaces.

7. The electrode element of claim 1 wherein said conductive members are in the form of current distributor panels.

8. The electrode element of claim 7 wherein the current distributor panels are positioned perpendicular to the electrode surfaces.

9. The electrode element of claims 7 or 8 wherein the current distributor panels are arranged vertically.

10. The electrode element of claim 9 wherein the current distributor panels have holes.

11. The electrode element of claim 7 wherein the current distributor panels are welded to the electrode rods.

12. The electrode element of claim 7 wherein the current distributor panels have angular profiles.

13. The electrode element of claim 1 wherein the conductive members are in the form of rings coaxial to the electrode rod.

14. The electrode element of claim 13 wherein the rings have radially projecting ring attachments whose axial length is less than the corresponding axial length of said rings.

15. The electrode element of claim 13 wherein the rings and the electrode rod are fabricated from a single piece of material.

16. The electrode element of claim 13 wherein the rings have radially projecting ring attachments connected to the electrode surfaces.

17. The electrode element of claim 16 wherein the ring attachments are connected to the electrode surfaces by resistance welding.

18. The electrode element of claim 1 wherein the conductive members have cam-shaped profiles spirally traversing the circumference of the electrode rod.

19. The electrode element of claim 18 wherein an even number of symmetrical cam-shaped conductive members is provided on the circumference of the electrode rod.

20. The electrode element of claim 18 wherein radially projecting, stepped cam shoulders are provided on the cam-shaped conductive members and are connected to the electrode surfaces.

21. The electrode element of claim 20 wherein the stepped cam shoulders are connected to the electrode surfaces by resistance welding.

22. The electrode element of claim 1 wherein the electrode rods extend through the electrode frame and are connected to said frame in a gas-tight, liquid-tight manner.

23. The electrode element of claim 22 wherein the electrode rods are connected to the electrode frame by welding.

24. The electrode element of claim 1 wherein the electrode surfaces comprise expanded metal.

25. The electrode element of claim 1 wherein the electrode surfaces comprise perforated sheet metal.

26. The electrode element of claim 1 wherein the electrode surfaces comprise wire mesh.

27. The electrode element of claim 1 wherein the electrode surfaces comprise individual wires.

28. The electrode element of claim 1 wherein the electrode surfaces are welded to the electrode frames.

29. The electrode element of claim 1 wherein the electrode surfaces are cathode surfaces.

30. The electrode element of claim 1 wherein the electrode surfaces are anode surfaces.

* * * * *